US005687699A

United States Patent [19]

Shimada et al.

[11] Patent Number: 5,687,699

[45] Date of Patent: Nov. 18, 1997

[54] CONTROLLER FOR MULTI-CYLINDER ENGINE

[75] Inventors: Kousaku Shimada; Takeshi Atago, both of Hitachinaka; Yoshiyuki Yoshida, Hitachi, all of Japan

[73] Assignee: Hitachi, Ltd., Japan

[21] Appl. No.: 698,157

[22] Filed: Aug. 7, 1996

[30] Foreign Application Priority Data

Aug. 8, 1995 [JP] Japan ..... 7-202326

[51] Int. Cl.[6] ..... F02D 41/14

[52] U.S. Cl. ..... 123/673; 123/674

[58] Field of Search ..... 123/673, 691, 123/692, 674

[56] References Cited

U.S. PATENT DOCUMENTS 4,934,328 6/1990 Ishii et al. ..... 123/673

5,462,037 10/1995 Hasegawa et al. ..... 123/673

FOREIGN PATENT DOCUMENTS 59-206619 11/1984 Japan ..... 123/673

5-69971 10/1993 Japan .

*Primary Examiner*—Tony M. Argenbright

*Attorney, Agent, or Firm*—Evenson, McKeown, Edwards & Lenahan, P.L.L.C.

[57] ABSTRACT

In a multi-cylinder engine, amounts of fuel injection supplied to respective cylinders are individually corrected on the basis of a signal from A/F sensors in the number less than the number of cylinders of the engine, for example, one A/F sensor, so that the air/fuel ratios for respective cylinders are feedback-controlled at a substantially uniform predetermined air/fuel ratio. Therefore, it is possible to perform precise air/fuel ratio control so as to accurately maintain the air/fuel ratio of the engine at the stoichiometric air/fuel ratio, to reduce the concentrations of HC, CO, and NOx in exhaust gas.

8 Claims, 11 Drawing Sheets

α1～α3… AVERAGED VALUE OF A AFTER PASSING THROUGH HIGH AND LOW LEAVES OF THRESHOLD VOLTAGE OF 0.2 SENSOR TWICE

| T2 OF #1 (ms) | 1.0 | 1.5 | ··· | 9.5 | 10.0 |
|---|---|---|---|---|---|
| #2 CORRECTION FACTOR $X_1$ | 0.972 | 0.985 | | 1.022 | 1.023 |

MAP OF #2 CORRECTION FACTOR $X_1$

| Ne (rpm) \ $T_2$ OF #1 | 1.0 | 1.5 | · · · · | 10.0 |
|---|---|---|---|---|
| 600 | 0.972 | 0.985 | | 1.000 |
| 800 | 0.975 | 0.988 | | 1.000 |
| ⋮ | ⋮ | ⋮ | | |
| 7000 | 1.000 | 1.000 | · · · · | 1.021 |

CONTROLLER FOR MULTI-CYLINDER ENGINE

BACKGROUND OF THE INVENTION

The present invention relates to a controller for a multi-cylinder engine, and, more particularly, to a controller for a multi-cylinder engine which can control supply of fuel for each cylinder.

1. Field of the Invention

An engine for an automobile is designed to perform air/fuel ratio feedback control by using an air/fuel ratio sensor mounted in an exhaust pipe to meet strict emission regulations and to obtain good fuel consumption performance.

In conventional engine controllers for a multi-cylinder engine, as described in Japanese Patent Publication No. 5-69971, air/fuel ratio control has been performed for uniformly controlling the supply of fuel fed to cylinders, being based on a detection signal of one air/fuel ratio sensor mounted in an exhaust pipe. In addition, also when compensation is made for aging effect of a fuel injection valve for supplying fuel to the associated cylinder, fuel injection valves for all cylinders are totally and uniformly compensated, regardless of aging effects of respective fuel injection valves for the cylinders. That is, the conventional controller for a multi-cylinder engine has performed the air/fuel ratio control on all cylinders with an average air/fuel ratio, but have not performed it with a air/fuel ratio suitable for each of the respective cylinders. Thus, it has been impossible to perform the air/fuel ratio control with high accuracy.

In other words, although the conventional air/fuel ratio control can provide air/fuel ratio feedback control using the average fuel-air ratio for all cylinders of the multi-cylinder engine, it does not provide the air/fuel ratio feedback control which compensates the averaged air/fuel ratio for uneveness among cylinders caused by, for example, difference in injection characteristic among the fuel injection valves for the respective cylinders, or in the amount of intake air distributed to the respective cylinders.

Thus, in the conventional air/fuel ratio control, even if the average air/fuel ratio matches the desired air/fuel ratio, a certain cylinder may have an air/fuel ratio richer than the target air/fuel ratio, while another cylinder may have an air/fuel ratio leaner than the desired air/fuel ratio. In such cylinders, since combustion occurs in an air/fuel ratio offset from the desired air/fuel ratio, the concentrations of HC, CO and NOx in the exhaust gas largely changes so that the concentrations in the exhaust gas cannot be accurately set to desired values. For example, if the air/fuel ratio in a certain cylinder becomes rich, the HC and CO concentrations in the exhaust gas increases, and the purification ratio of catalyst provided in the exhaust pipe deteriorates for HC and CO so that the HC and CO concentration of would become high in the exhaust gas, downstream of the catalyst. On the contrary, if the air/fuel ratio in a certain cylinder becomes lean, since the purification ratio of the catalyst for NOx deteriorates, the NOx concentration becomes high downstream of the catalyst. Anyway, the exhaust gas becomes disagreeable.

SUMMARY OF THE INVENTION

The object of the invention is to provide an engine controller which can control the air/fuel ratio for respective cylinders of a multi-cylinder engine with the use air/fuel ratio sensors having a number less than the number of cylinders.

To attain the above object, according to the present invention, there is provided an engine controller for a multi-cylinder engine including fuel supply means for individually supplying fuel to respective cylinders of the multi-cylinder engine, and air/fuel ratio sensor means for detecting an air/fuel ratio, downstream of a manifold of exhaust pipes from respective cylinders, wherein air/fuel ratio feedback control is carried out by controlling the supply of fuel from the fuel supply means in accordance with an output of the sensor means, the engine controller comprising processing means for detecting differences between fuel supply characteristics of the fuel supply means for a reference cylinder which is one of the cylinders of the multi-cylinder engine and fuel supply characteristics of the fuel supply means for cylinders other than the reference cylinder, and for setting thus detected differences as correction values for cylinders other than the reference cylinder, and control means for correcting the fuel supply characteristics of the fuel supply means for the cylinders other than the reference cylinder whereby the air/fuel ratios of cylinders are controlled at the average air/fuel ratio.

With the above arrangement, since the processing means determines correction data necessary for correcting the differences between the fuel supply characteristics of the fuel supply means for the reference cylinder and those of the fuel supply means for cylinders other than the reference cylinder, and the control means corrects the supply of fuel fed into the cylinders other than the reference cylinder, it is possible to eliminate the uneveness of air/fuel ratios among the cylinders, so that combustion at a stoichiometric air/fuel ratio can be attained for all cylinders by performing the air/fuel ratio feedback control to obtain the average air/fuel ratio to the desired air/fuel ratio or the stoichometric air/fuel ratio. Consequently, the air/fuel ratio feedback control can be attained at a high degree of precision whereby the multi-cylinder engine can sufficiently control the concentration of HC, CO and NOx in the exhaust gas.

Explanation will be made of the present invention in detail with reference to the accompanying drawings.

DESCRIPTION OF THE PREFERRED EMBODIMENTS

Figure 1:
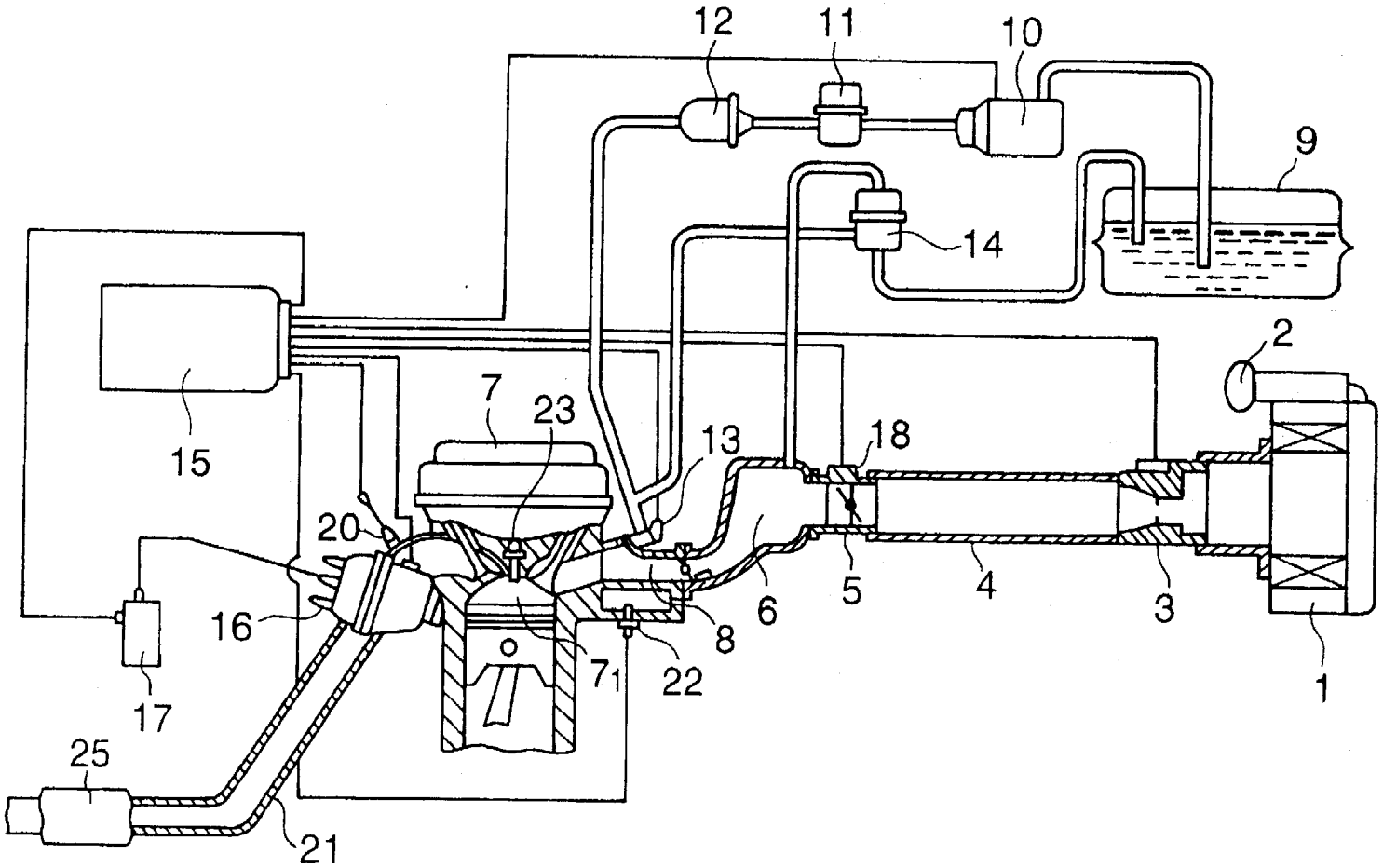
FIG. 1 is a schematic diagram showing an example of an engine system to which the present invention is applied.

Now, the engine controller according to the present invention will be explained in detail with respect to the illustrated embodiments as follows:

FIG. 1 shows an example of a engine system to which an embodiment of the present invention is applied. In this figure, a multi-cylinder engine 7 has n cylinders (n is integer which is equal to or larger than 2). Air introduced by the engine 7 (intake air) is taken through an intake section 2 of an air cleaner 1, and is led into a collector 6 by way of an air meter 3, an air duct 4, and a throttle valve body 5 including a throttle valve for controlling the flow rate of intake air. Then, the intake air is distributed to individual intake air pipes 8 connected to respective cylinders of the engine 7 by the collector 6, and is then introduced into a cylinder $7_1$ at first.

On the other hand, fuel such as gasoline is sucked from the fuel tank 9 by a fuel pump 10, then pressurized, and is supplied to a fuel system in which a fuel damper 11, a fuel filter 12, a fuel injection valve (injector) 13, and a fuel pressure regulator 14 are connected. Further, the pressure of the fuel is regulated to a predetermined pressure by the fuel pressure regulator 14, and is then injected into an intake pipe 8 from a fuel injection valve 13 mounted thereon. Accordingly, there are provided n fuel injection valves 13. Here, these fuel injection valves 13 may be an in-cylinder injection type which directly injects the fuel into the individual cylinders.

With the above-mentioned arrangement, the air fowmeter 3 delivers a signal representing the intake air flow rate, to a control unit 15.

In addition, the throttle valve body 5 is equipped with a throttle sensor 18 for detecting an opening degree of the throttle valve, and the throttle sensor 18 delivers its output to the control unit 15.

Then, a distributor 16 contains a crank angle sensor which is designed so as to deliver a reference angular signal REF representing an angular position of a crank shaft, and an angular signal POS for detecting a rotational speed (number of revolution) of the crank shaft also into the control unit 15.

The exhaust pipe 21 incorporates an air/fuel ratio (A/F) sensor 20 which delivers an output signal to the control unit 15. Here, the air/fuel ratio sensor 20 is the one for detecting the air/fuel ratio during actual operation of the engine, and may be of a type for detecting the air/fuel ratio over a wide range from rich to lean, or of a type for detecting whether an air/fuel ratio is richer or leaner than a predetermined air/fuel ratio.

The engine 7 is further equipped with a water temperature sensor 22 and spark plugs 23, and the exhaust pipe 21 is equipped therein with catalyst (three-way catalyst) 25.

Figure 2:
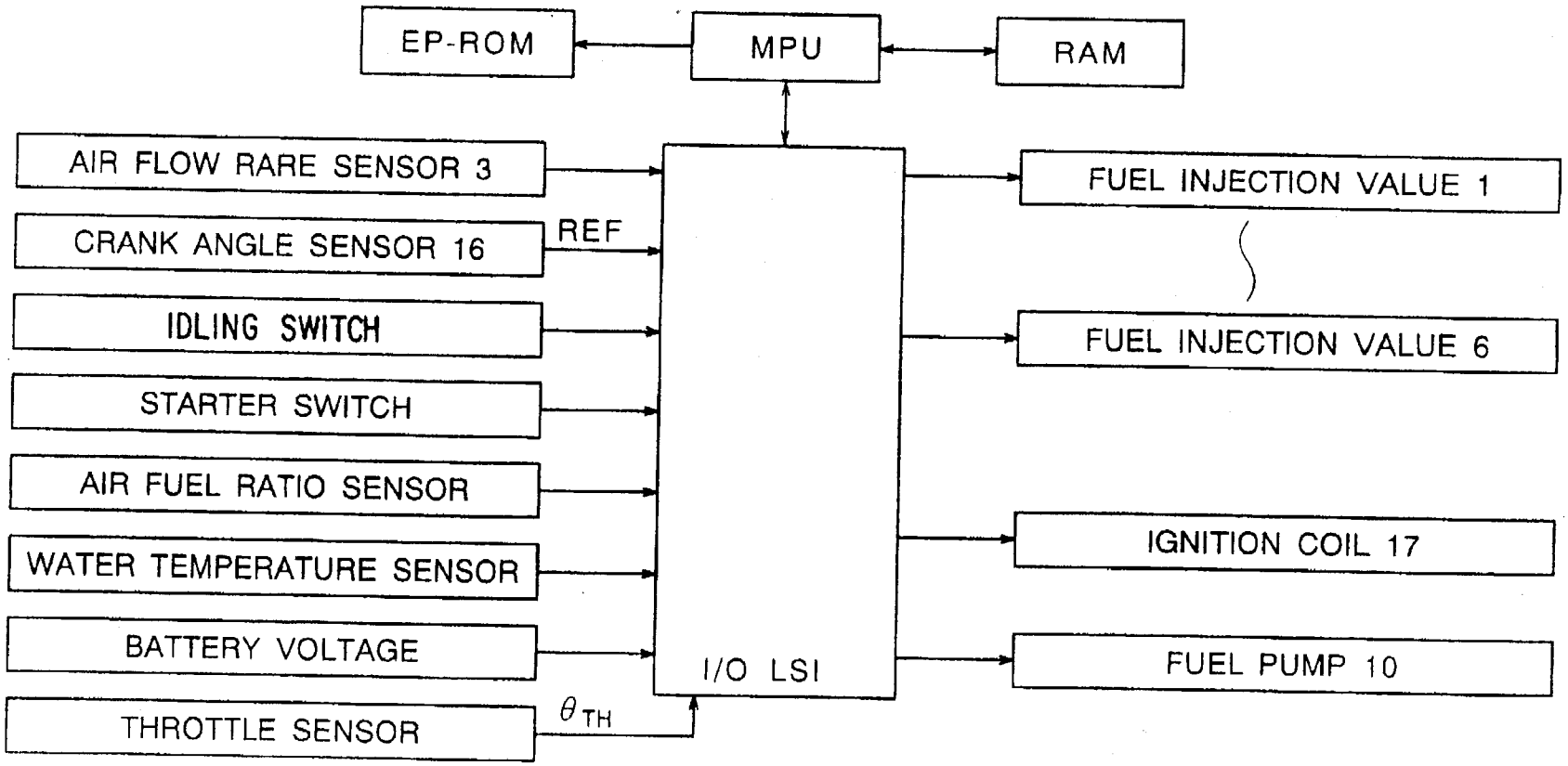
FIG. 2 is a block diagram showing an engine control system to which an engine controller as an embodiment of the present invention is applied.

The essential section of the control unit 15 is designed, as shown in FIG. 2, to receive, as an input, various signals from an MPU, a ROM, and an A/D converter, and various sensors for detecting operating conditions of the engine, to execute predetermined computation, to deliver various control signals calculated as the result of the computation, and to supply predetermined control signals to the fuel injection valve 13 and an ignition coil 17 for controlling the fuel supply, and the ignition timing.

Figure 3:
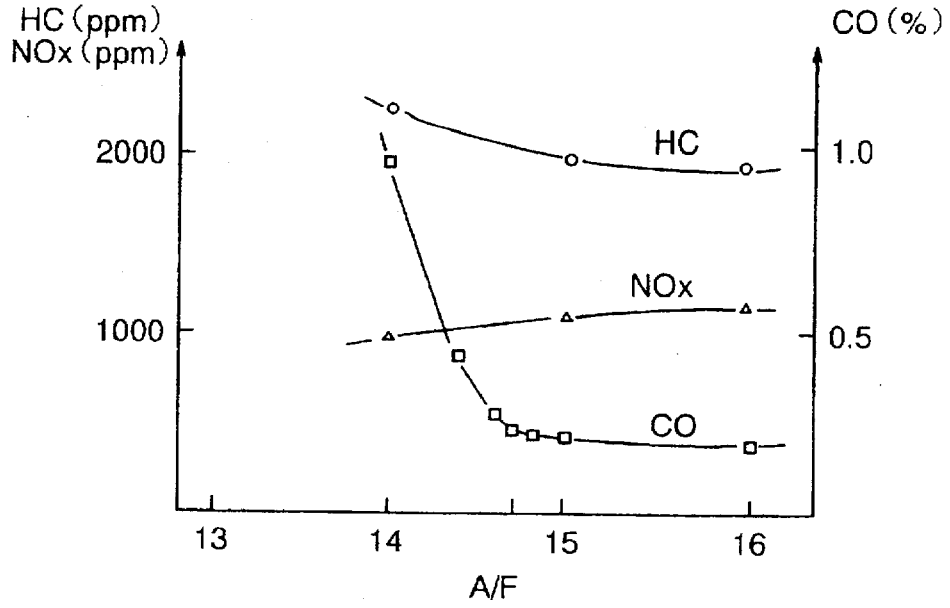
FIG. 3 is a view showing characteristic curves representing relationship between the concentrations of exhaust gas components and the air/fuel ratio of an engine.
Figure 4:
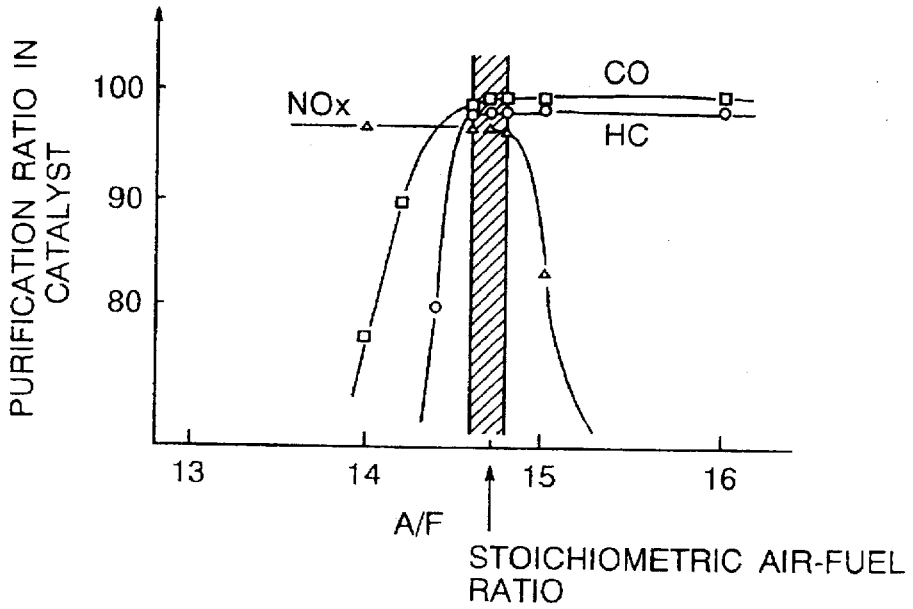
FIG. 4 is a view showing characteristics curves representing relationship between the purification ratio of catalyst and the air/fuel ratio of the engine.

FIG. 3 shows the relationship between the air/fuel ratio when it is varied near the stoichiometric air/fuel ratio (A/F=14.7) and the concentration of toxic components in the exhaust gas, and FIG. 4 shows the relationship between the air/fuel ratio and the purification rate of the three-way catalyst.

First, as for the state of the exhaust gas near the stoichiometric air/fuel ratio, the concentrations of HC (hydrocarbon) and NOx (nitrogen oxides) exhibit not so significant change even if the air/fuel ratio becomes either richer or leaner, while the concentration of CO (carbon oxide) becomes greatly high if it becomes richer.

In addition, as clearly seen from FIG. 4, if the air/fuel ratio becomes richer than the theoretical air/fuel ratio, the purification ratio of catalyst for CO and HC drastically decreases. On the contrary, if it becomes leaner than the theoretical air/fuel ratio, the purification ratio of catalyst for NOx drastically decreases.

As seen from the characteristics shown in FIGS. 3 and 4, it is necessary to control the air/fuel ratio of the engine on operation within a narrow range around the stoichiometric air/fuel ratio so as to suppress the toxic components exhausted after the catalyst 25. Thus, the control unit 15 carries out the air/fuel ratio feedback control in accordance with an output signal from the air/fuel ratio sensor 20 so as to determine an injection time of the fuel injection valve 13 so that the air/fuel ratio of the engine converges to the desired air/fuel ratio, for example, the stoichiometric air/fuel ratio.

However, with this arrangement alone, every cylinder of the multi-cylinder engine is operated with the air/fuel ratio averaged for all cylinders, which is set to the stoichiometric air/fuel ratio. Accordingly, there may be presented cylinders which is operated with a richer air/fuel ratio or a leaner air/fuel ratio due to unevenness of intake distribution to the cylinders or the like, and because the purification ratio characteristics of catalyst is not linear, the exhaust gas is more significantly influenced by the lower purification ratio so that concentrations of all of HC, CO, and NOx are increased.

Therefore, to suppress the toxic components exhausted downstream of the catalyst 25, it is necessary to eliminate unevenness of the air/fuel ratio among the cylinders and to improve the average fuel-air ratio so that it is within a narrow band around the stoichiometric air/fuel ratio as shown in FIG. 3.

Figure 5:
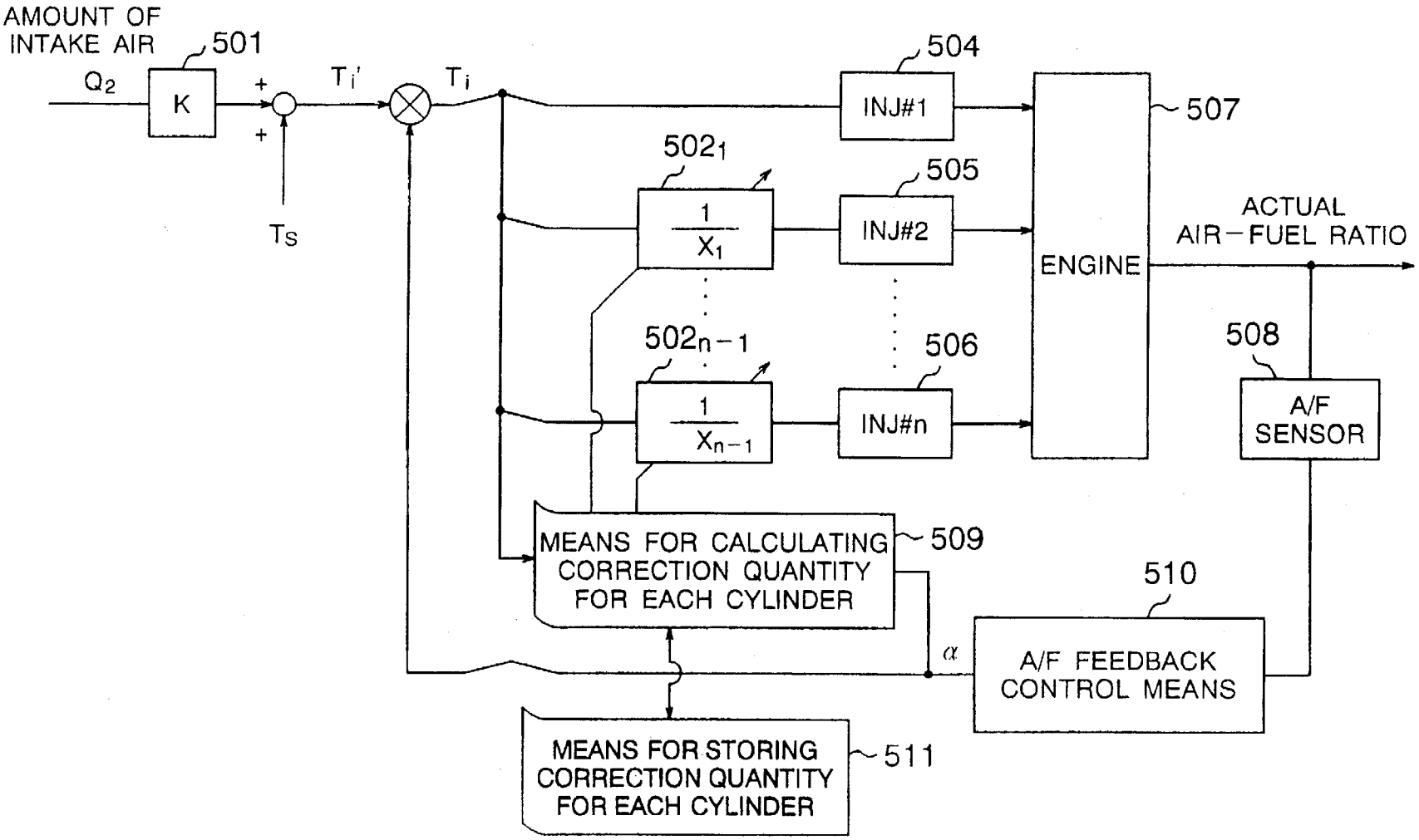
FIG. 5 is a control block diagram showing the engine controller as an embodiment of the present invention.

Then, in this embodiment, the control shown in FIG. 5 is performed by the control unit 15.

First, when the amount of intake air Q*a* is multiplied by a factor K, and is added thereto with an ineffective injection time Ts, and therefore, a fuel injection pulse width Ti' for a fuel injection valve INJ for each cylinder can be determined.

Then, the fuel injection pulse width Ti' is inputted into the fuel injection valves INJ #1 (504)–INJ #n (506) to supply fuel to the engine 507.

Then, an air/fuel ratio feedback loop is formed by detecting the air/fuel ratio at that moment with the use of the A/F sensor 508, finding out a control quantity a at an A/F feedback control means 510, and multiplying the fuel injection pulse width Ti' by this control quantity a to obtain the fuel injection pulse width Ti.

In this case, the control quantity a has a large value so as to increase the amount of fuel injection when the actual air/fuel ratio is leaner than the theoretical air/fuel ratio, but has a small value so as to reduce the amount of fuel injection when the actual air/fuel ratio is richer than the stoichiometric air/fuel ratio.

Meanwhile, in the the prior art, the fuel injection pulse width Ti is delivered to all fuel injection valves INJ #1 (504)–INJ #n (506) which supply the fuel to the engine 507, but in the embodiment, a means 509 for calculating the correction quantity for each cylinder, means 511 for storing a correction quantity for each cylinder, and correction quantity calculating means 502 for respecctive cylinders, are provided, in addition to the components of the above-mentioned prior art.

Then, consequently, the embodiment is designed such that, for all fuel injection valves having an n–1 number, except for the first fuel injection valve INJ #1 (504), the fuel injection pulse width Ti supplied to them is corrected by the correction factors for the cylinders $\mathbf{502}_1 \ldots \mathbf{502}_n$, respectively.

These correction factors $\mathbf{502}_1 \ldots \mathbf{502}_n$ are calculated by the means 509 for calculating the correction value, and are stored in the means 511 for storing correction quantities for the respective cylinders as learning values.

Next, the operation for calculating each of the correction factors $\mathbf{502}_1 \ldots \mathbf{502}_n$ by the means 509 for calculating the correction quantity for each cylinder will be described with reference to the timing chart shown in FIG. 6.

The timing chart shows an example where the air/fuel ratio feedback control for three cylinders is carried out with the use of only one A/f sensor 508. For example, the air/fuel ratio feedback control is carried out for the cylinders of a straight three-cylinder engine or one bank of a V-shape six-cylinder engine. The A/F sensor 508 determines whether the air/fuel ratio is higher or lower than the theoretical air/fuel ratio. That is, if the air/fuel ratio is higher than the stoichiometric air/fuel ratio, a voltage higher than a reference voltage is outputted, and, contrarily, if it is lower, a voltage less than the reference voltage is outputted First, until the time A, the engine is assumed to operate at the stoichiometric air/fuel ratio. Under such condition, although the air/fuel ratio for a cylinder of the engine is not the stoichometric air/fuel ratio, and differs from one other, the air/fuel ratio feedback control is carried out so as to have the stoichiometric air/fuel ratio in average among all cylinders. That is, if the A/F sensor 508 detects an air/fuel ratio lower than the stoichometric air/fuel ratio, the air/fuel ratio feed-back control means 510 decrease the control quantity α to increases the air/fuel ratio (making the fuel leaner). On the contrary, if the A/F sensor 508 detects an air/fuel ratio higher than the stoichiometric air/fuel ratio, the air/fuel ratio feedback control means 510 performs air/fuel ratio feedback control so that the control quantity a is increased to reduce the air/fuel ratio (making the fuel richer). This all the feedback control quantity α to be set to α1 in average.

In such a condition, the air/fuel ratio for each of the cylinders is not at the stoichiometric air/fuel ratio, and differs from that of another cylinder. For example, cylinder #2 has an air/fuel ratio lower than that of cylinder #1 (in a richer fuel condition), so that a fuel increase factor for the fuel injection valve INJ #2 (amount of fuel injection to cylinder #2/amount of fuel injection to cylinder #1×100) is $X_1$. In addition, cylinder #3 has a higher fuel-air ratio than cylinder #1 (in a leaner fuel condition), and the fuel increase factor for the fuel injection valve #3 is $X_2$.

At the time A, the amount of fuel injection from the fuel injection valve INJ #2 for cylinder #2 is stepwise increased by, for example, 5% or less, so as to lower the air/fuel ratio of cylinder #2. Since this causes the A/F sensor 508 to detect an air/fuel ratio lower than the stoichiometric air/fuel ratio, the air/fuel ratio feedback control means 501 decreases the control quantity α to α2 so as to increase the air/fuel ratio (making the fuel leaner).

The stepwise change causes the control quantity α to require a predetermined time $T_{set}$ until it stabilizes to α1.

After the predetermined time expires, the stably obtained α1 is stored and used for calculating correction quantity.

In addition, when at the time B, the amount of fuel injection from the fuel injection valve INJ #3 for cylinder #3 is also stepwise increased by a predetermined amount of 5%, the control quantity α is similarly lowered to α3. After the predetermined time $T_{set}$ expires, the stably obtained α3 is stored for calculation of the correction quantity.

Then, in this embodiment, unknown fuel increase factors X1 and X2 are obtained from these stored values α1, α2, and α3, as follows.

Figure 6:
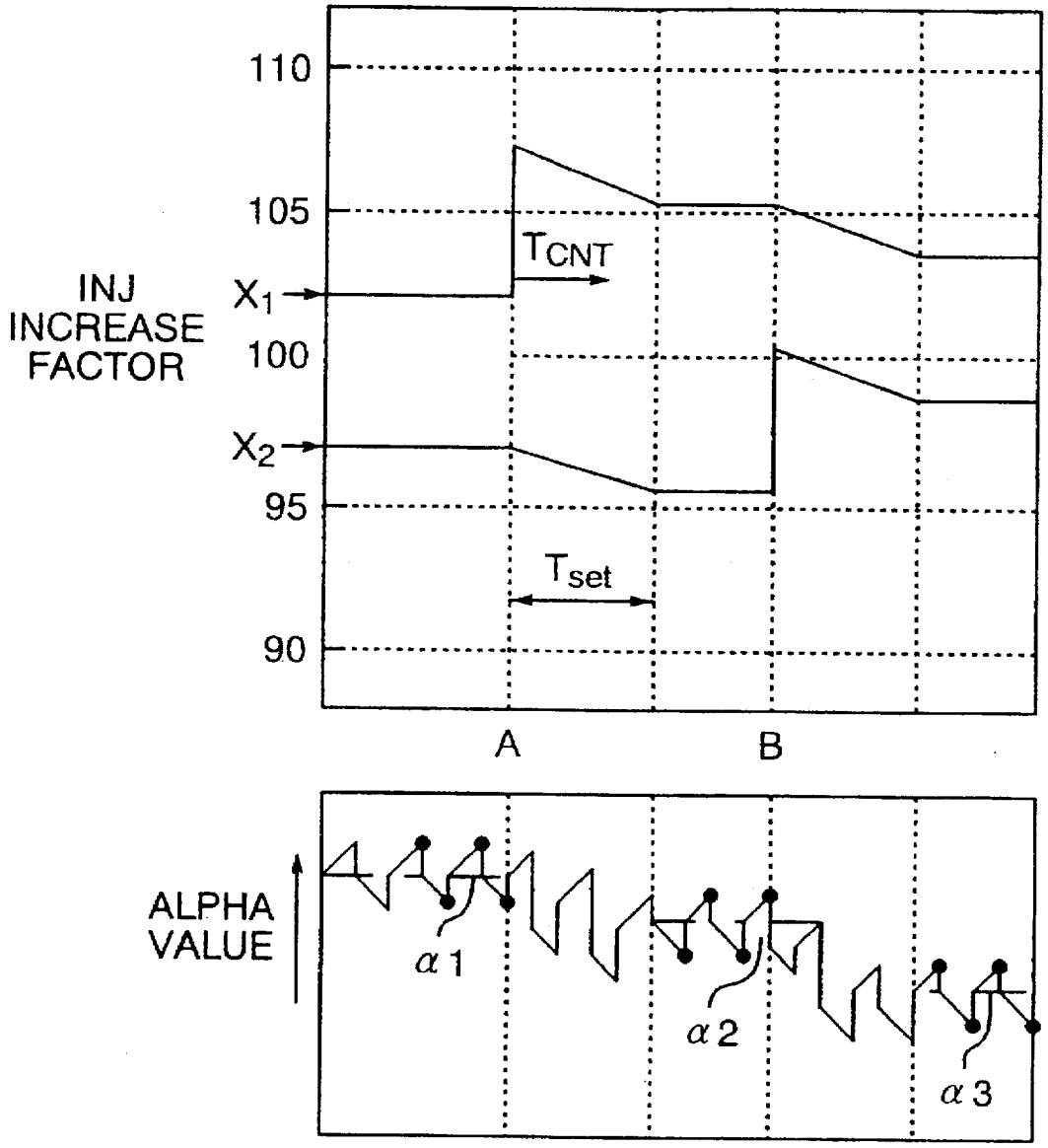
FIG. 6 is a timing chart showing the control operation by the engine controller in an embodiment of the present invention.

While, in the following description, there appears a factor of 1.05 since a rate of a predetermined increase at the times A and B is set to 5% as shown in FIG. 6. Accordingly, if another rate of increase is used, the vary of the factor differs from the above-mentioned value. Of course, the rate of increase may has any other value, and further, a rate of decrease may be used instead of the rate of increase.

First, referring to FIG. 6, since, in an equilibrium state whether the feedback quantity is either α1 or α2, any way, the air/fuel ratio as a whole is the same, and accordingly, the total amount of injected fuel should be equal so that Equation (1) is established.

[Equation 1]

$$\alpha_1(1+X_1+X_2)=\alpha_2(1+1.05X_1+X_2)$$

The left side of Equation (1) is the amount of fuel injection for three cylinders when equilibrium is established at the feedback control quantity α1, while the right side is the amount of fuel injection for three cylinders when equilibrium is established at the feedback control quantity α2.

Similarly, in the state where equilibrium is established at the control quantities α2 and α3, the following Equation (2) is established.

[Equation 2]

$$\alpha_2(1+1.05X_1+X_2)=\alpha_3(1+1.05X_1+1.05X_2)$$

Equations (3) and (4) are obtained by rearranging Equations (1) and (2) with respect to X1 and X2, respectively. In addition, Equation (5) is in a form of a determinant of Equations (3) and (4).

[Equation 3]

$$\alpha_1-\alpha_2(1.05\alpha_2-\alpha_1)X_1+(\alpha_2-\alpha_1)X_2$$

[Equation 4]

$$\alpha_2-\alpha_3 32\ 1.05\ (\alpha_3-\alpha_2)X_1+(1.05\alpha_3-\alpha_2)X_2$$

[Equation 5]

$$\begin{bmatrix} \alpha_1-\alpha_2 \\ \alpha_2-\alpha_3 \end{bmatrix} = \begin{bmatrix} 1.05\alpha_2-\alpha_1 & \alpha_2-\alpha_1 \\ 1.05(\alpha_2-\alpha_1) & 1.05\alpha_3-\alpha_2 \end{bmatrix} \begin{bmatrix} X_1 \\ X_2 \end{bmatrix}$$

Then, Equation (5) is modified to Equation (6), which is then represented as Equation (7) by replacing individual matrices to b, A, and x, respectively. Here, A is assumed as Equation (8).

[Equation 6]

$$\begin{bmatrix} 1 \\ 1 \end{bmatrix} = \begin{bmatrix} \frac{1.05\alpha_2\alpha_1}{\alpha_1-\alpha_2} & -1 \\ -1.05 & \frac{1.05\alpha_3-\alpha_2}{\alpha_2-\alpha_3} \end{bmatrix} \begin{bmatrix} X_1 \\ X_2 \end{bmatrix}$$

[Equation 7]

$$b = \begin{bmatrix} a_{11} & a_{12} \\ a_{21} & a_{22} \end{bmatrix} X$$

[Equation 8]

$$b=AX$$

Then, to find unknown quantities X1 and X2, that is, a column vector x from the determinant in the form of Equation (6) or (7), it is sufficient to modify the equation as Equation 19—Equation 20—Equation 21.

[Equation 19]

$$b=AX$$

[Equation 20]

$$A^{-1}b=A^{-1}AX$$

[Equation 21]

$$A^{-1}b=X$$

However, since the above modifications requires to previously find an inverse matrix $A^{-1}$ of the matrix A, this is described in the following.

If the matrix A is a matrix of 2×2 as represented by Equation (6), an inverse matrix of A can be found from the determinant and a cofactor matrix of A as shown in Equation (22).

[Equation 22]

$$A^{-1} = \frac{1}{|A|} \begin{bmatrix} A_{11} & A_{21} \\ A_{12} & A_{22} \end{bmatrix}$$

Here, when the matrix A is represented as Equation (8), an inverse matrix of Equation (22) becomes an inverse matrix of Equation (23).

[Equation 23]

$$A^{-1} = \frac{1}{a_{11}\cdot a_{22}-a_{12}\cdot a_{21}} \begin{bmatrix} a_{22} & -a_{21} \\ -a_{12} & a_{11} \end{bmatrix}$$

Then, substituting the inverse matrix of Equation (23) into Equation 21 obtains the matrix of Equation (24). Equations (25) and (26) have final forms obtained by finding the unknown quantities X1 and X2, and by representing them with the feedback quantity α.

[Equation 24]

$$\begin{bmatrix} X_1 \\ X_2 \end{bmatrix} = \frac{1}{a_{21}\cdot a_{22}-a_{12}\cdot a_{21}} \begin{bmatrix} a_{22} & -a_{21} \\ -a_{12} & a_{11} \end{bmatrix} \begin{bmatrix} 1 \\ 1 \end{bmatrix}$$

[Equation 25]

$$X_1 = \frac{1}{a_{11}\cdot a_{22}-a_{12}\cdot a_{21}}(a_{22}-a_{21}) = \frac{1}{\frac{1.05\alpha_2-\alpha_1}{\alpha_1-\alpha_2}\cdot\frac{1.05\alpha_3-\alpha_2}{\alpha_2-\alpha_3}-1.05}\left(\frac{1.05\alpha_3-\alpha_2}{\alpha_2-\alpha_3}+1.05\right)$$

[Equation 26]

$$X_2 = \frac{1}{a_{11}\cdot a_{22}-a_{12}\cdot a_{21}}(a_{11}-a_{12}) = \frac{1}{\frac{1.05\alpha_2-\alpha_1}{\alpha_1-\alpha_2}\cdot\frac{1.05\alpha_3-\alpha_2}{\alpha_2-\alpha_3}-1.05}\left(\frac{1.05\alpha_2-\alpha_1}{\alpha_1-\alpha_2}+1\right)$$

While the process for finding Equations (25) and (26) from Equations (1) and (3) has been described, if, in the actual engine, the forms of Equations (25) and (26) found by calculation on the desk are programmed in a microcomputer, X1 and X2 can be easily calculated on the basis of observed feedback control quantity α.

Meanwhile, although description has been made of the calculation in a case where one A/F sensor is used for three cylinders, the principle of the present invention can be applied for a case where one A/F sensors is used for four cylinders, with the use of similar calculation That is, in this case, since the feedback control quantity α is increased by one, and the unknown quantity X is also increased by one, the number of order in the determinant is increased by one, so that Equations (9), (11), and (13) correspond to Equations (1) and (3), and Equations (10), (12), and (14) are obtained by rearranging the Equations (9), (11), and (13) with respect to X1, X2, and X3.

[Equation 9]

$$\alpha_1(1+X_1+X_2+X_3)=\alpha_2(1+1.05X_1+X_2+X_3)$$

[Equation 10]

$$\alpha_1-\alpha_2=(1.05\alpha_2-\alpha_1)X_1+(\alpha_2-\alpha_1)X_2+(\alpha_2-\alpha_1)X_3$$

[Equation 11]

$$\alpha_2(1+1.05X_1+X_2+X_3)=\alpha_3(1+1.05X_1+1.05X_2+X_3)$$

[Equation 12]

$$\alpha_2-\alpha_3=1.05(\alpha_3-\alpha_2)\,X_1+(1.05\alpha_3-\alpha_2)\,X_2+(\alpha_2-\alpha_1)X_3$$

[Equation 13]

$$\alpha_3(1+1.05X_1+1.05X_2+X_3)=\alpha_4(1+1.05X_1+1.05X_2+1.05X_3)$$

[Equation 14]

$$\alpha_3-\alpha_4=1.05(\alpha_4-\alpha_3)X_1+1.05(\alpha_4-\alpha_3)X_2+(1.05\alpha_4-\alpha_3)X_3$$

Then, Equation 15 is a determinant of Equations (10), (12), and (14), and can be modified into Equation (16).

[Equation 15]

$$\begin{bmatrix} \alpha_1-\alpha_2 \\ \alpha_2-\alpha_3 \\ \alpha_3-\alpha_4 \end{bmatrix} = \begin{bmatrix} 1.05\alpha_2-\alpha_1 & \alpha_2-\alpha_1 & \alpha_2-\alpha_1 \\ 1.05(\alpha_2-\alpha_1) & 1.05\alpha_3-\alpha_2 & \alpha_2-\alpha_1 \\ 1.05(\alpha_4-\alpha_3) & 1.05(\alpha_4-\alpha_3) & 1.05\alpha_4-\alpha_3 \end{bmatrix} \begin{bmatrix} X_1 \\ X_2 \\ X_3 \end{bmatrix}$$

[Equation 16]

$$\begin{bmatrix} 1 \\ 1 \\ 1 \end{bmatrix} = \begin{bmatrix} \dfrac{1.05\alpha_2-\alpha_1}{\alpha_1-\alpha_2} & -1 & -1 \\ -1.05 & \dfrac{1.05\alpha_3-\alpha_2}{\alpha_2-\alpha_3} & -1 \\ -1.05 & -1.05 & \dfrac{1.05\alpha_4-\alpha_3}{\alpha_3-\alpha_4} \end{bmatrix} \begin{bmatrix} X_1 \\ X_2 \\ X_3 \end{bmatrix}$$

Since Equation (16) similar to Equation (6) can be modified to the forms of Equations (17) and (18), the calculation for finding X1, X2, and X3 is same as the above-mentioned case where one air/fuel ratio sensor is used for three cylinders.

[Equation 17]

$$b=\begin{bmatrix} a_{11} & a_{12} & a_{13} \\ a_{21} & a_{22} & a_{23} \\ a_{31} & a_{32} & a_{33} \end{bmatrix} X$$

[Equation 18]

$$b=AX$$

Then, description will be made of software performing the process for stepwise increasing the fuel for each cylinder, the process for fetching the α value after the air/fuel ratio feedback is stabilized, and the process for calculating the correction factor X, with reference to the flow-charts of FIGS. 7–9.

Figure 7:
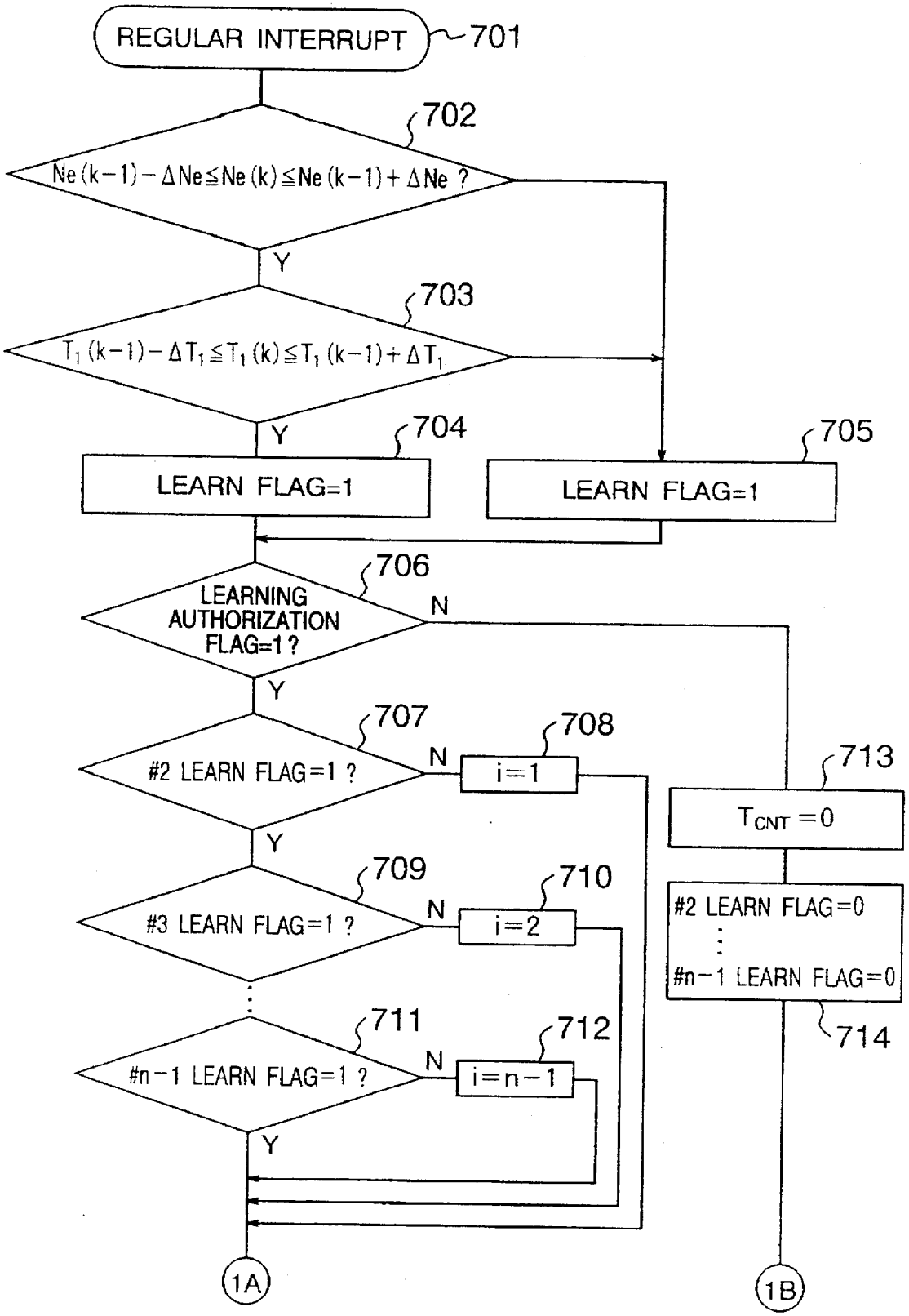
FIG. 7 is a flow-chart representing the operation of the engine controller in the embodiment of the present invention.
Figure 8:
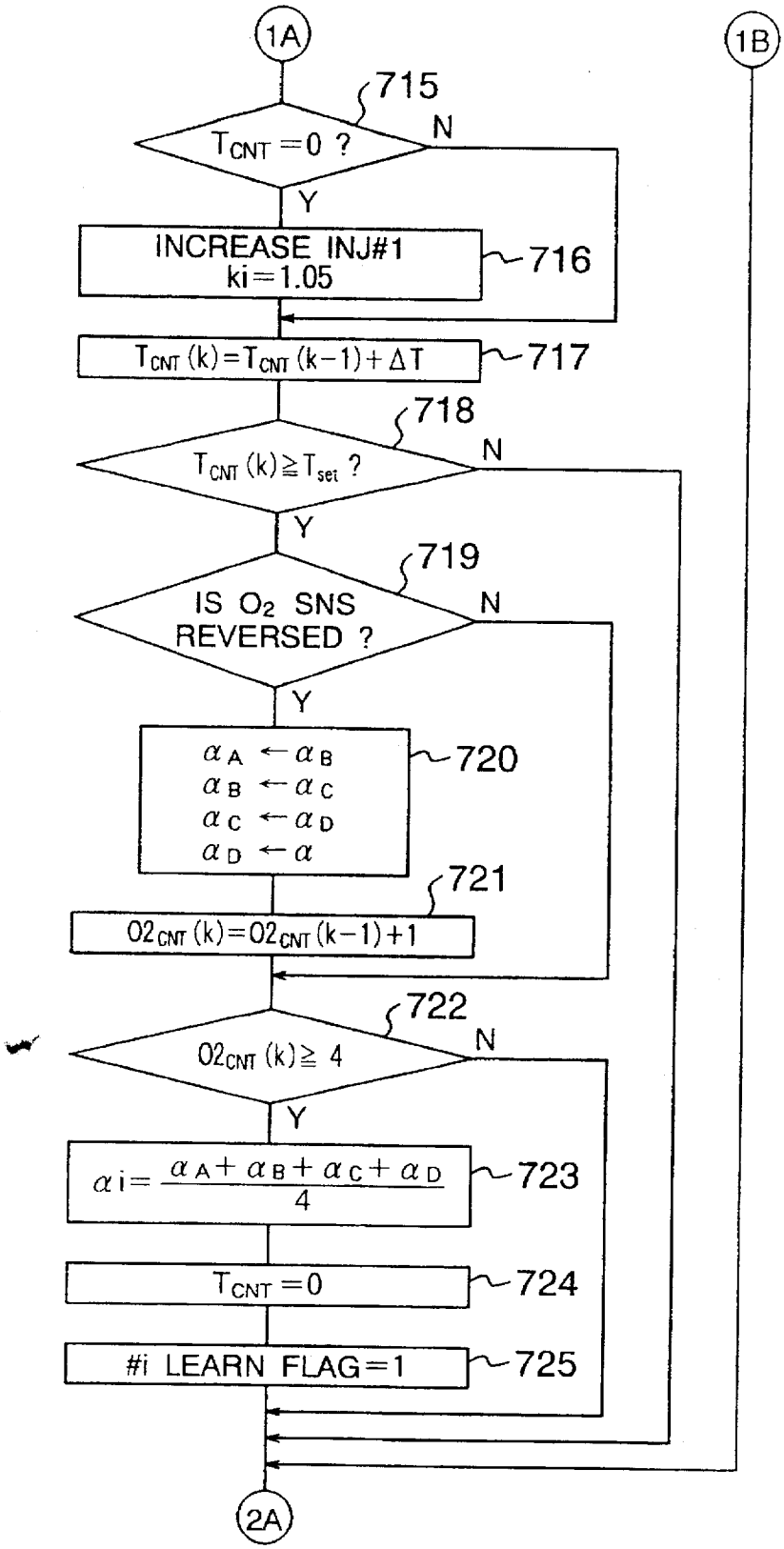
FIG. 8 is a flow-chart representing the operation of the engine controller in the embodiment of the present invention.
Figure 9:
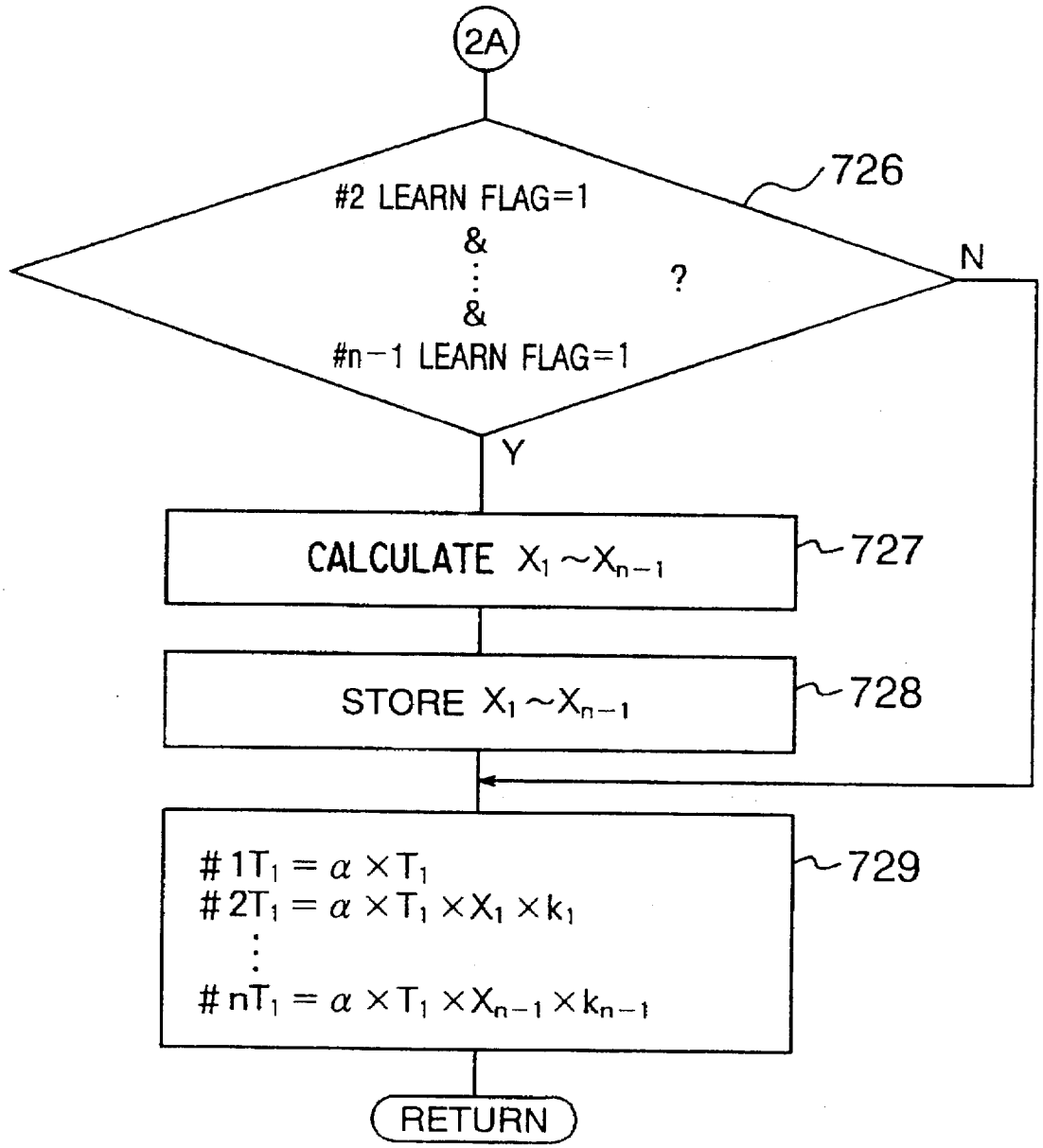
FIG. 9 is a flow-chart representing the operation of the engine controller in the embodiment of the present invention.

These flow-charts of FIG. 7–9 are indicated by a generalized example where the number of cylinders is n, and one air/fuel ratio sensor is used. An $O_2$ sensor is used as the air/fuel ratio sensor.

Step 701 is executed as an interrupt process performed in every predetermined time (for example, 10 ms) by a program of a microcomputer in the control unit 15. First, step 702 determines whether or not the engine speed Ne is within a predetermined range in comparison with that upon previous calculation. At step 703, it is determined whether or not the fuel injection time Ti is within a predetermined range in comparison with that upon the previous calculation. That is, steps 702 and 703 are to confirm whether or not the engine is in a steady-state operation.

Then, if both number of revolution Ne and fuel injection time Ti are values close to those upon the previous calculation, a learning authorization flag is set to 1 in step 704, or otherwise, it is set to 0 at step 705 to inhibit learning.

Then, at step 706, it is determined whether the learning authorization flag is 1 or 0.

Then, at first, if the flag is 0, that is, leaning is not authorized, a counter $T_{cnt}$ is set to 0 at step 713. The counter $T_{cnt}$ is to count an elapsing time from the time when the amount of fuel injection is stepwise increased. The elapsing time may be determined by counting the number of revolutions of the engine performed or the number of ignition.

The process proceeds to step 714 where all LEARN flags for cylinder #2 to cylinder #n–1 are reset to 0.

On the other hand, when the flag is set to 1 at step 706, that is, learning is determined to be authorized, the process proceeds from step 707 to step 711 where what cylinder the learning proceeds up to is determined while a cylinder to be learned at this moment is identified at steps 708, 710, and 712.

Then, if the counter $T_{cnt}$ is determined to be 0 at step 715, the process proceeds to step 716 so as to stepwise increase the amount of fuel injected into the cylinder by the fuel injection valve. At the next step 717, the count on the counter $T_{cnt}$ is incrased.

Then, at step 718, it is determined whether a predetermined time $T_{set}$ elapses from the time of the stepwise increase of the amount of fuel injection. At the next step 719, it is determined whether or not rich and lean of an $O_2$ sensor (A/F sensor) are reversed after the previous process. If the signal is reversed, stored four α values are shifted, and the number of reverse $O_{2cnt}$ of the $O_2$ sensor signal is increased at step 721.

In step 722, it is determined whether or not the number of reverse $O_{2cnt}$ of the $O_2$ sensor signal is four or more. If it is four or more, the process of steps 723, 724, and 725 is performed.

First, at step 723, four as are averaged, at step 724, the counter $T_{cnt}$ is initialized, and, at step 725, the flag $L_{earn}$ meaning completion of learning of the cylinder to be learned is set to 1.

Then, at step 726, if the learning completion flags $L_{earn}$ for all cylinders to be learnt are 1, it is considered that the learning completes, and a process of steps 727 and 728 is performed. That is, first, at step 727, the correction factor X is calculated by Equation (25), and, at step 728, the calculated X is stored.

Finally, at step 729, the thus calculated and stored correction factor X is read out to correct the amount of fuel injection for each cylinder.

Then, explanation will be made of storing of the correction quantity X for the fuel injection valve for each cylinder.

Figures 10, 11:
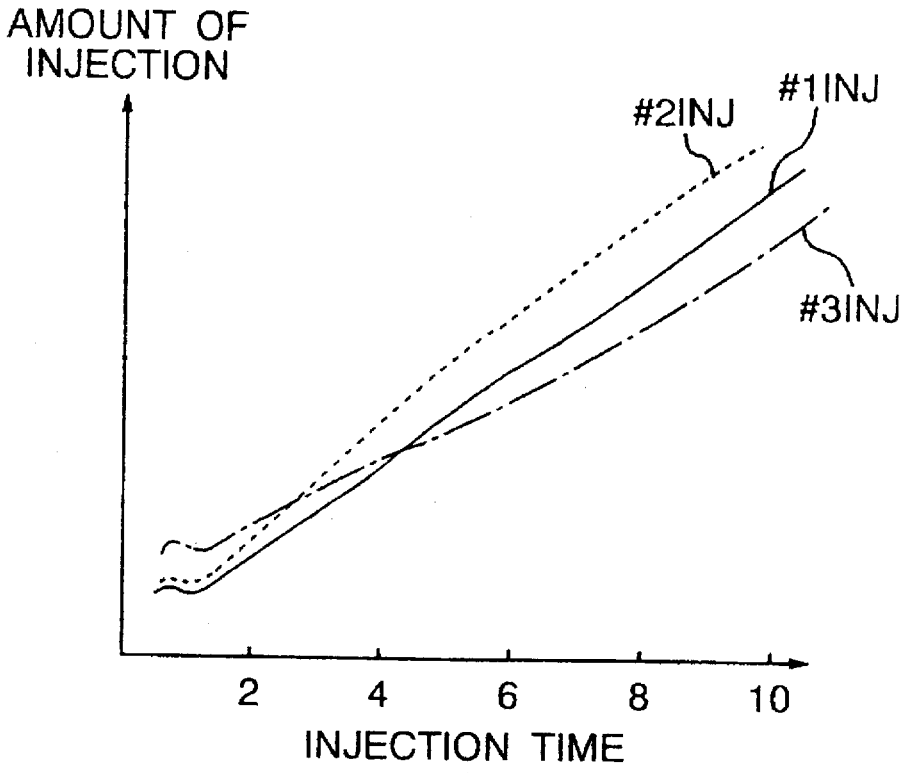
FIG. 10 is a graph showing the characteristics of a fuel injection valve.
FIG. 11 is an example of correction learning tables used by the engine controller in the embodiment of the present invention.

The relationship between the injection time of the fuel injection valve and the amount of injection is as shown in FIG. 10, and there is unevenness between the fuel injection valves.

Therefore, the embodiment of the present invention is arranged to determine a certain fuel injection valve as a reference one, and to store differences between the reference one and other cylinders as the correction qualities. Storing in this case uses either a process shown in FIG. 11 or that shown in FIG. 12.

First, in the process shown in FIG. 11, storing the correction factor X in the form of a table for every injection time of the reference fuel injection valve. Therefore, a system having one air/fuel ratio sensor for n cylinders would have n–1 tables.

Figures 12, 13:
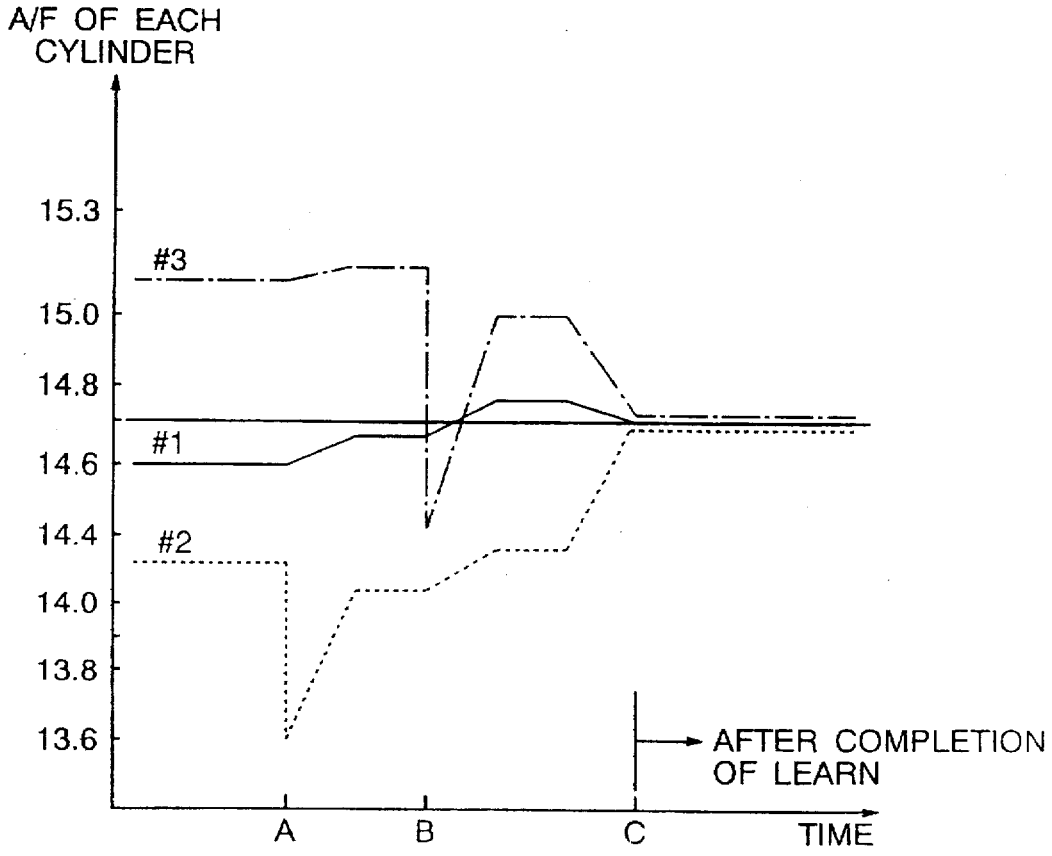
FIG. 12 is an example of correction learning tables used by the engine controller in the embodiment of the present invention.
FIG. 13 is a timing chart showing the operation of the engine controller in the embodiment of the present invention.

Then, in the process shown in FIG. 12, a process of storing the correction factor X in the form of a map of the injection time of the reference fuel injection valve v.s. the number of revolution of the engine. Therefore, a system using one air/fuel ratio sensor for n cylinders would have n−1 maps.

Now, transition of the air/fuel ratio in each cylinder when the process of the embodiment is described with reference to FIG. 13.

First, before the time A, while the air/fuel ratio as an average among all cylinders is set to the stoichometric air/fuel ratio as a desired value, the air/fuel ratios for cylinders are not set to the stoichiometric air/fuel ratio, that is, are uneven.

However, when it is the time A, a process is first performed to learn a correction factor X2 by increasing the amount of fuel injection for cylinder #2 by the predetermined amount, and, then, after time B, a process is performed to learn a correction factor X3 by increasing the amount of fuel injection for cylinder #3 by the predetermined amount.

Then, subsequent to the completion of these learning, after the time C, since the amounts of fuel injections for both cylinders #2 and #3 are corrected with the use of the correction factors X2 and X3, the difference in air/fuel ratio from that of cylinder #1 is eliminated, and the air/fuel ratio for all cylinders can be converged to the stoichometric air/fuel ratio.

Therefore, in this embodiment, since the air/fuel ratio for each cylinder can be converged to the stoichiometric theoretical air/fuel ratio only by setting the average air/fuel ratio for all cylinders the stoichiometric air/fuel ratio through the air/fuel feedback control, it is possible to attain precise air/fuel control, so that the operation can be always surely performed at the stoichiometric air/fuel ratio, allowing it to sufficiently reduce the concentrations of HC, CO, and NOx which are toxic components in the exhaust gas.

According to the present invention, since the unevenness of the air/fuel ratio for cylinders of a multi-cylinder engine is eliminated only by using the air/fuel ratio sensor in the number less than the number of cylinders, for example, using only one air/fuel ratio sensor, and since it is possible to perform precise air/fuel control in which the air/fuel ratios of all cylinders are matched to the average air/fuel ratio, respectively, the air/fuel ratio for the engine can be always accurately maintained at the stoichiometric air/fuel ratio, so that the concentrations of HC, CO, NOx which are toxic components in the exhaust gas can be sufficiently reduced.

Figure 14:
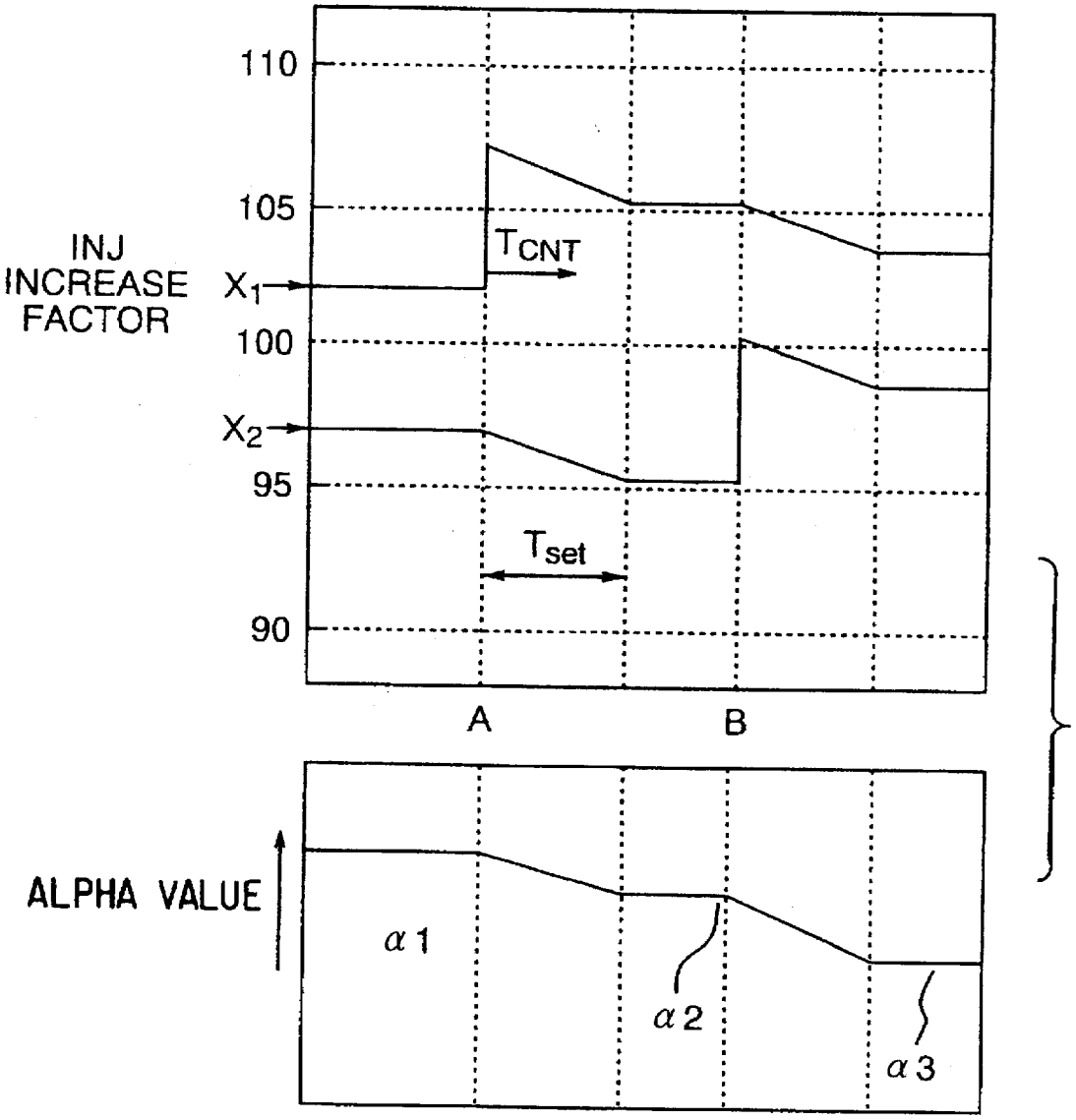
FIG. 14 is a timing chart showing the control operation carried by the engine controller when a linear measuring A/F sensor used for a modified embodiment of the present invention is used.

While the present invention has been described in detail in the form of an embodiment, the invention should not be exclusively limited to such embodiment, but various modification can be made thereto within the scope as set forth in the appended claims. For example, in the above-mentioned embodiment, while the A/F sensor 508 measures whether the air/fuel ratio is higher or lower than the stoichiometric air/fuel ratio, that is, it measures whether the concentration of oxygen in the exhaust gas is richer or leaner than a predetermined value, linear measuring of the air/fuel ratio, or linear measuring of the oxygen concentration in the exhaust gas may be also used. In this case, the control quantity $\alpha$ by the air/fuel ratio feedback control as illustrated in FIG. 6 is exhibited as shown in FIG. 14, and step 719 can be omitted in the process for calculating the correction factor X illustrated in FIGS. 7–9.

What is claimed is:

1. An engine controller for a multi-cylinder engine including fuel supply means for separately supplying fuel to respective cylinders of the multi-cylinder engine, and air/fuel ratio sensor means for detecting an air/fuel ratio at a location downstream of a manifold of exhaust pipes from the cylinders, wherein air/fuel ratio feedback control is obtained by controlling supply of fuel through said fuel supply means in accordance with an output of said sensor means, said engine controller comprising:

processing means for detecting, as a correction value for each cylinder, differences between fuel supply characteristics of the fuel supply means for a reference cylinder which is one of said multiple cylinders and fuel supply characteristics of the fuel supply means for each of cylinders other than said reference cylinder; and control means for correcting the fuel supply characteristics of the fuel supply means for an associated cylinder with the correction value for each cylinder, whereby the air/fuel ratio of each cylinder is controlled to be equal to an averaged air/fuel ratio among said cylinders of the multi-cylinder engine.

2. An engine controller as set forth in claim 1, wherein said sensor means comprises an O2 sensor for determining whether an oxygen concentration in exhaust gas is higher or lower than a predetermined value.

3. An engine controller as set forth in claim 1, wherein said sensor means comprises an A/F sensor for linearly detecting an air/fuel ratio from an oxygen concentration in exhaust gas.

4. An engine controller as set forth in claim 1 further comprising correction value storage means which stores said correction values for the respective cylinders in the form of a table.

5. An engine controller as set forth in claim 1 further comprising correction value storage means which stores said correction values for the respective cylinders in the form of a map which contains a number of the cylinders and an engine speed as search data.

6. An engine controller as set forth in claim 1, wherein said averaged air/fuel ratio is a stochiometric air/fuel ratio.

7. A method of performing air/fuel feedback control for a multi-cylinder engine in which fuel supply means for separately supplying fuel to respective cylinders of the multi-cylinder engine, and air/fuel ratio sensor means for detecting an air/fuel ratio downstream of a manifold of exhaust pipes from said respective cylinders, and in which an averaged control quantity is calculated for said respective cylinders in accordance with an output from said sensor means, and the amount of fuel from said fuel supply means is determined by said control quantity, said method comprising the steps of:

setting one of said cylinders of said multi-cylinder engine as a reference cylinder while setting cylinders other than said reference cylinder as cylinders to be corrected, and successively varying the amounts of fuel injection from the fuel supply means to said cylinders to be corrected by a predetermined amount;

finding differences between air/fuel feedback control quantities obtained from variations in the amount of fuel injection for said cylinders to be corrected, and said average control quantity, and storing said differences; and finding correction factors for said respective cylinders to be corrected by computing said differences for the whole number of cylinders n with the use of (n−1) simultaneous equations.

8. An air/fuel ratio feedback control method as set forth in claim 7, wherein said averaged air/fuel ratio is a stoichometric air/fuel ratio.

* * * * *